US007392984B2

(12) United States Patent
Rohde et al.

(10) Patent No.: US 7,392,984 B2
(45) Date of Patent: Jul. 1, 2008

(54) PROCESS FOR GUIDING PRINTING MEDIA AND PRINTING MEDIA GUIDE

(75) Inventors: Domingo Rohde, Kiel (DE); Lars Seimetz, Achterwehr (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/887,581

(22) Filed: Jul. 9, 2004

(65) Prior Publication Data

US 2005/0006837 A1 Jan. 13, 2005

(30) Foreign Application Priority Data

Jul. 12, 2003 (DE) ..... 103 31 626

(51) Int. Cl.
*B65H 5/00* (2006.01)

(52) U.S. Cl. ..... 271/264; 271/194; 406/86

(58) Field of Classification Search ..... 271/195, 271/197, 264, 193, 188, 185, 186; 374/104; 406/86, 88, 92; 226/97.3; 34/639, 640
See application file for complete search history.

(56) References Cited

U.S. PATENT DOCUMENTS

| | | | | |
|---|---|---|---|---|
| 3,070,901 | A * | 1/1963 | Allander et al. | 226/97.3 |
| 3,334,896 | A * | 8/1967 | Mullin | 271/108 |
| 3,398,913 | A * | 8/1968 | Orlando | 242/332.3 |
| 3,405,977 | A | 10/1968 | Albright | 302/29 |
| 4,113,247 | A * | 9/1978 | Phillips | 271/264 |
| 4,480,777 | A * | 11/1984 | Suzuki et al. | 226/15 |
| 5,102,118 | A * | 4/1992 | Vits | 271/195 |
| 5,209,387 | A * | 5/1993 | Long et al. | 226/97.3 |
| 5,833,228 | A * | 11/1998 | Nagata et al. | 271/11 |
| 6,279,898 | B1 * | 8/2001 | Stephan | 271/195 |
| 6,416,051 | B1 * | 7/2002 | Autz | 271/195 |
| 6,431,858 | B1 * | 8/2002 | Rutz | 432/59 |
| 6,435,088 | B2 | 8/2002 | Fujimoto | |
| 6,543,662 | B1 * | 4/2003 | Kuhlmann et al. | 226/97.3 |
| 6,572,100 | B1 * | 6/2003 | Tranquilla | 271/195 |
| 6,626,103 | B2 | 9/2003 | Neumann | |
| 6,726,203 | B1 * | 4/2004 | Michel et al. | 271/264 |
| 6,739,254 | B2 * | 5/2004 | Frankenberger et al. | 101/232 |
| 6,899,327 | B2 * | 5/2005 | Shimizu et al. | 271/276 |
| 2003/0013034 | A1 | 1/2003 | Behnke et al. | |
| 2003/0184008 | A1 * | 10/2003 | Ingelsten | 271/196 |
| 2004/0041327 | A1 * | 3/2004 | Jensen | 271/90 |
| 2004/0080102 | A1 * | 4/2004 | Hachimann et al. | 271/264 |

FOREIGN PATENT DOCUMENTS

| | | | |
|---|---|---|---|
| DE | 3629720 | A1 | 4/1987 |
| DE | 19624136 | A1 | 1/1997 |
| DE | 199 45 285 | A1 * | 3/2001 |

* cited by examiner

*Primary Examiner*—David H. Bollinger
*Assistant Examiner*—Jeremy R Severson
(74) *Attorney, Agent, or Firm*—Donna P. Suchy

(57) ABSTRACT

Guiding a printing medium that is being conveyed along a travel path in a printing machine, whereby the printing medium is not making contact along at least one edge. A stream of sucked air (9) is directed at least partially outward, with respect to at least one edge (5) of the printing medium. A printing media guide with at least one air suction mechanism (8) for sucking air out of the area of the travel path of the printing medium (1) in order to create a suction air stream (9) is directed at least partially outwards.

7 Claims, 2 Drawing Sheets

PROCESS FOR GUIDING PRINTING MEDIA AND PRINTING MEDIA GUIDE

FIELD OF THE INVENTION

The invention relates in general to guiding a printing medium that is being conveyed along a travel path in a printing machine, whereby the printing medium is not making contact along at least one edge.

BACKGROUND OF THE INVENTION

In printing machines, especially in electrophotographic printing machines, printing media such as paper, for example, are conveyed along a path of travel with the aid of conveyor belts, traction systems, or the like.

Printing media can be conveyed such that only certain areas of the printing media come into contact with the appropriate conveying elements. For example, the printing medium can lie midway on an electrostatic conveyor belt and be conveyed thereby while one edge or even both edges of the printing medium make no contact.

This freedom of contact of the edges can, for example, be necessary when microwave fuser mechanisms are used, as is proposed in DE 101 45 005 A1. In such case, for example, toner can initially be fused on the edges of the printing medium by microwaves. Because contacts made by the printing medium directly downstream of the microwave applicators can lead to smeared print images, it is desirable that the printing medium be conveyed in such a way that no contact is made with the edges. To achieve this purpose, the use of an electrostatic conveyor belt for conveying the printing medium is preferred, whereby the conveyor belt is set up such that the middle section of printing medium lies on the conveyor belt.

If the printing medium is conveyed such that the edges do not make contact, undesirable movements of the edges can occur. The edge can begin to flutter or become bent in an undesirable way; it can, in particular, hang down or roll up, or the like.

The undesirable movements can cause reductions in print quality. The layer of toner can be adversely affected or, inside a lithographic or ink jet printing machine, ink that has not yet dried can run. If the path of travel runs through another mechanism, the movements of the edges of the printing medium can result in the medium making contact with or bumping into feed-in slots that are present. This can damage the printing medium, or cause a paper jam.

SUMMARY OF THE INVENTION

The object of the subject invention is, therefore, to introduce a process and a way of guiding printing media which help to prevent undesirable movements of the edges of a printing medium that is being conveyed along a travel path, whereby at least one of its edges does not make contact.

The object of the invention is achieved with respect to process by using a stream of sucked air that is directed at least partially outward with respect to at least one edge of the printing medium. The sucking of air in the vicinity of the printing medium essentially prevents turbulent air currents in these areas, and the edges of the printing medium are either guided with greater stability or actively stabilized. Parts of this air stream that are directed in the direction of the path of travel can additionally support the travel movement of the printing medium.

In a particularly beneficial embodiment, provision is made with respect to the process for the air stream to flow above and/or below the printing medium. By layers of air streams above and/or below the printing medium, the edges become more stably guided. In particular, it is possible by regulating these air streams to generate or to improve desirable curving of the printing medium edges. If the air stream is, for example, reduced on one side of the printing medium (if reduced to zero then the printing medium will be guided only on one side) then the printing medium edge will be curved in the opposite direction.

The object that underlies the invention is additionally achieved by guiding the printed medium by at least one air suction mechanism that is used for suctioning the air out of the area of the printing medium's travel path, thereby creating an air stream that is at least partially directed outwards. The advantages of such an air stream have already been described.

In a beneficial embodiment of the printing media guide, the air suction mechanism generates an air stream that supports the printing medium from above and/or below. In this way the printing medium edge can, as described, be curved in a desired manner. A particularly rigid shape of the printing medium edge can be created, in which practically no warping exists. Conveyance of the printing medium through slots, for example in a microwave mechanism, is then easily achieved without the risk of making contact. An adverse affect on the quality of a printed image on the printing medium caused by undesired movement can thus be precluded with even greater certainty.

In a particularly beneficial further development of the printing media guide, the air suction mechanism incorporates a wall that has air vents and borders laterally on the printing medium's travel path. By the use of air vents it is beneficially possible to create a more even air stream, whereby a more stable guidance of the printing medium edges is made possible. In particular, it can be possible by an array of air vents distributed differently in the wall to vary the location of the air stream. For example, a faster moving stream of air can be generated above the printing material in this way. Thus, when necessary, a curving of the printing medium edge resulting from its own weight can be beneficially compensated.

By skillful distribution of the air vents, it can also be made possible to better adjust the printing medium to changes within the printing medium's travel path. To generate a more even air stream, the air suction mechanism has at least one antechamber. In this way an even negative pressure, which then creates the air stream, can be created across a wider area parallel to the travel path.

In a beneficial further development of the printing media guide at least one air guide element that acts upon the air stream is provided. This air guide element conducts an air stream such that it also beneficially acts in places that are not directly in the vicinity of the area in which the air stream is created. Thus, the sphere of influence of the printing media guide becomes more flexible. In addition, the air stream can, by this guide, be better directed so that air currents that influence the printing medium can be created more precisely.

In order to maintain the printing medium edge in a more rigid alignment or to create a desired curving, it is necessary that the air stream be able to act upon the upper and/or the lower side of the printing medium. Consequently provision has been made according to the invention that at least one, but preferably two, air guide elements located above and/or below the printing medium extend into the area of the travel path, essentially in a plane parallel to the printing medium.

The plane of the air guide elements need not necessarily be parallel to the printing medium. Deviations from such a parallel plane within the range of several degrees are certainly tolerable, because in such case stable guidance of the printing medium edge would nevertheless continue.

Often, different types of paper or printing media with varying widths are processed inside the printing machine. The printing media guide must, therefore, be so flexible that it can (1) guide printing media with maximum width, as well as with minimal width, and/or (2) stabilize the edges of the printing media. Thus, with respect to the apparatus, provision is made for the air guide elements to border on the air suction mechanism and to extend into the area of the travel path of the narrowest conceivable printing medium, and thus provide an expanded sphere of influence for the printing media guide. The air suction mechanism delimits the sides of the travel path and thus limits the maximum width that a printing medium may have. By the air guide elements according to the invention the air stream is directed even into the areas of the edge of the narrowest conceivable printing medium. This edge can thereby be advantageously guided or stabilized. In this way, great flexibility with respect to the guidance of printing media of various widths can be achieved.

In a beneficial embodiment of the printing media guide according to the invention, provision is made for the air suction mechanism and the air guide elements to follow the course of the conveyor travel path. This allows the printing media guide to beneficially assure for stability and guidance of the printing medium edges along various courses of the conveyor travel path. In this embodiment, the printing media guide is located essentially always in the same plane as the conveyor path, even when the plane of the conveyor path curves or changes in some other way. In this way, the printing media guide can, for example, even follow a helix-shaped conveyor path, such as is introduced for the turnover mechanism in DE 100 59 913C2.

Inside a printing machine, printing media can be guided onto different planes. For a turnover mechanism, for example, the conveyor path can, for example, have a commensurate curve radius. The surface of the printing medium is then proportionately curved. By the printing media guide, according to the invention, the edges of the printing media can be stably guided even as this curving takes place.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, to which, however, the scope of the invention is not limited, in which.

DETAILED DESCRIPTION OF THE INVENTION

Figure 1:
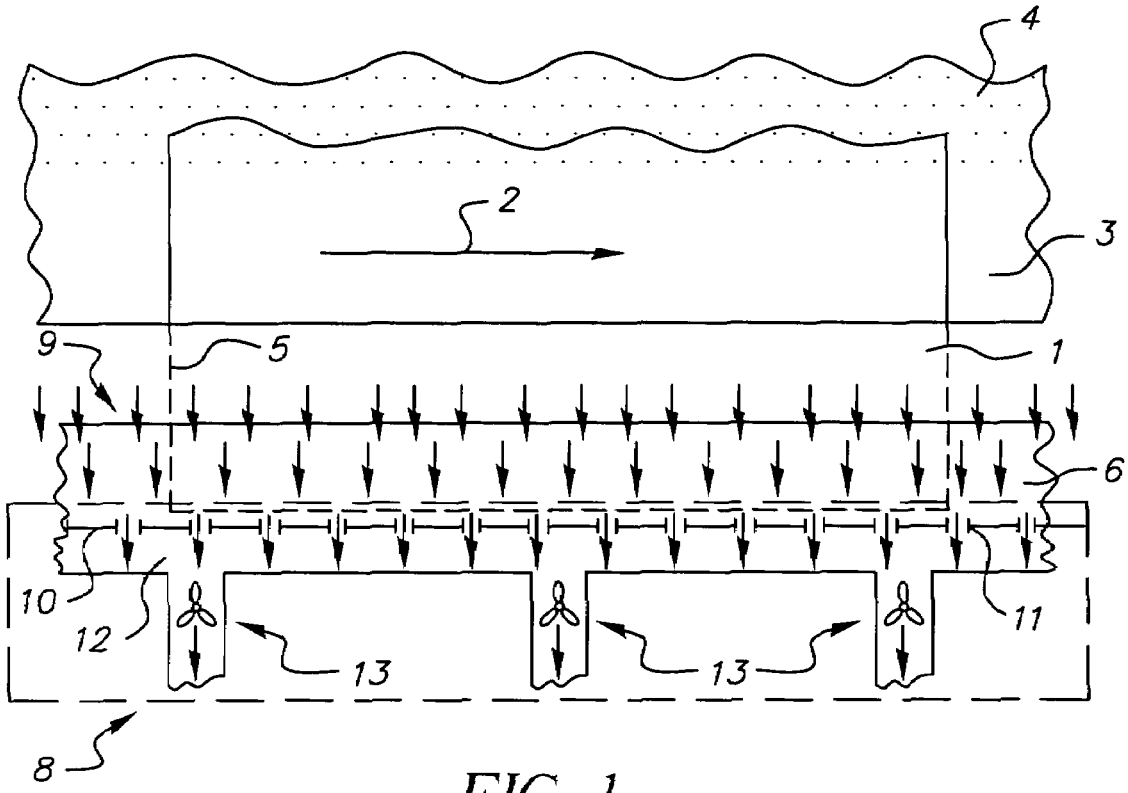
FIG. 1 is an overhead view of a printing media guide.

FIG. 1 shows a printing media guide according to the invention. The view is from overhead. A printing medium 1 is being conveyed on a conveyor path in the direction of arrow 2. Impetus for the movement is transferred to the printing medium 1 via a conveyor belt 3. In principle, the printing medium 1 can be held on the conveyor belt 3 in various ways, for example, by electrostatic energy. With respect to the conveyor belt 3 shown here, the printing medium 1 is held to the conveyor belt 3 by vacuum induced through suction holes 4.

Figure 2:
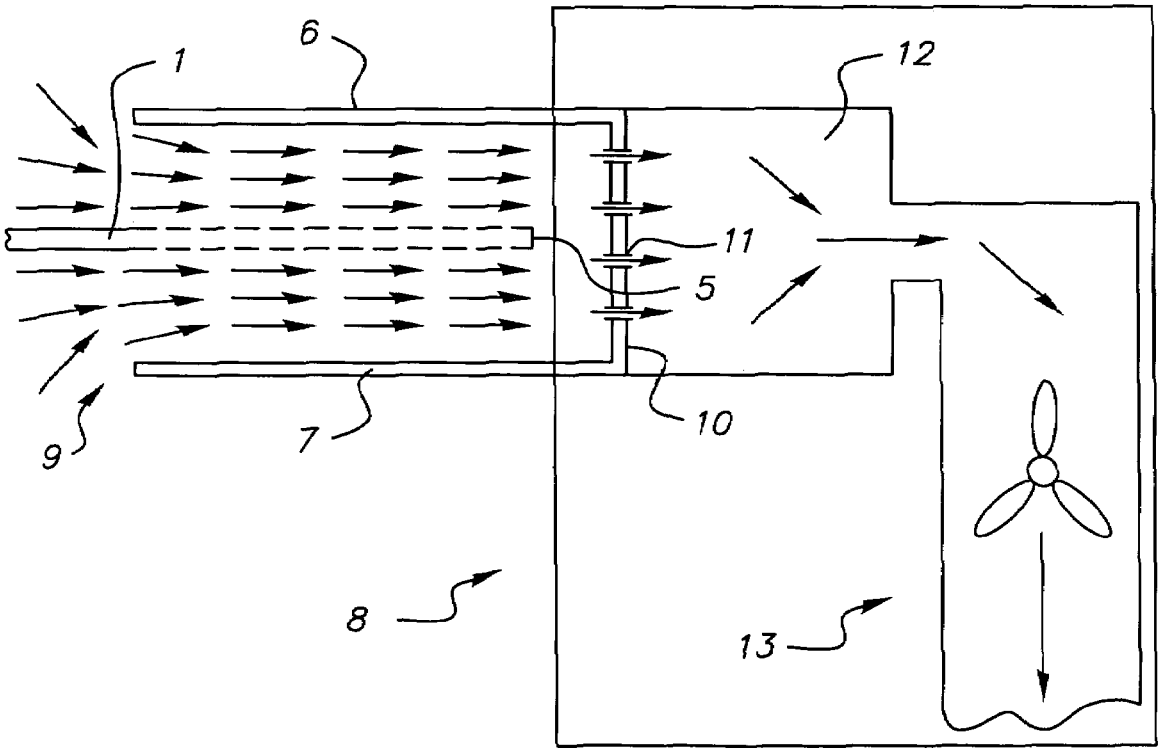
FIG. 2 is a cross section through an air suction mechanism.

An edge area 5 of the printing medium shown by the dashed lines, also referred to hereinafter as edge 5 or printing medium edge 5, is located in the vicinity of air guide elements 6 and 7. In the overhead view shown here, only the upper air guide element 6 is visible. In FIG. 2, both air guide elements 6 and 7 can be seen. The air guide elements 6 and 7 connect to an air suction mechanism 8. A cross section of the air suction mechanism 8 is shown in FIG. 2.

The printing medium 1 is guided on the conveyor belt 3, such that the edge area 5 of the printing medium 1 lies midway between the two air guide elements 6 and 7. In a conventional arrangement of a printing media guide, the printing medium 1 would simply lie on the conveyor belt 3. The edge areas 5 would, for one thing, hang down because of their own weight and/or be so affected by turbulent air currents that undesirable waving or other bending would occur. The edges 5 of the printing medium 1 could also begin to flutter.

With the use of the printing media guide shown here, undesirable bending and/or fluttering of the printing medium edges 5 can be successfully avoided. Between the air guide elements 6 and 7, a suction-induced air stream 9, is symbolically represented by arrows. The suction induced air stream 9 has a stabilizing and guiding effect on the printing medium edges 5 so that, depending upon the need, either curving or straightening out can occur, whereby the suction induced air stream 9 is preferably used to stabilize the edges 5. In the case shown here, at least one printing medium edge 5 lies even with and parallel to the air guide elements 6 and 7. The air guide elements 6 and 7 border on a wall 10 that delimits the travel path of the printing medium 1. This wall 10 has air vents 11. The wall 10 is part of the air suction mechanism 8.

Behind the wall 10, the air suction mechanism 8 has an antechamber 12. In this antechamber 12 an even negative pressure can build up. Then, air can be sucked commensurately evenly through the air vents 11 in the wall 10, and out of the area between the air guide elements 6 and 7, so that an even stream of suction air 9 can arise therein and assure that the printing medium edges 5 are stably guided. The printing medium edges 5 are prevented by the constant stream of suction air 9 above and below the printing medium from deviating from their flat, midway position.

In order for the antechamber 12 to build up a negative pressure, air is pumped out of this antechamber 12 by fans or pump mechanism 13. As shown in FIG. 1, several pump mechanisms 13 can be used in order to create the appropriate negative pressure. However, configurations with only one pump mechanism 13 are conceivable.

A desired bending of the edge of a printing medium 5 can be achieved by the printing media guide according to the invention. For this to happen, it is sufficient to direct the suction air stream 9 above and/or below the printing medium 1, such that, through relative differences in pressure that are created via different steam velocities, a force impacts upon the printing medium edge 5 that bends it in the desired manner. To achieve this result, the locational array of air vent holes 11 in the wall 10 can, for example, be varied commensurately.

Figure 3:
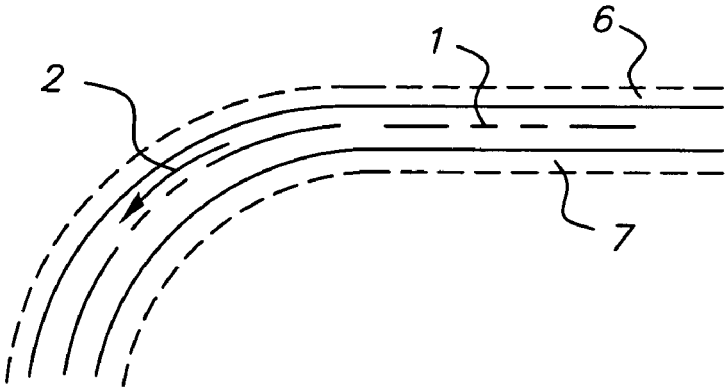
FIG. 3 is a sketched course of the printing media guide.

FIG. 3 shows a sketched course of a printing media guide. The printing medium 1 follows the travel path of printing medium 1. The printing medium 1 is conveyed by the above-described conveying elements in the direction shown by the arrow 2. The travel path shown in the example as a curved course. Such a course can, for example, be found in a turnover mechanism.

Air guide elements are located above and below the printing medium 1, and they are shown in FIG. 3 by dashed lines. They follow the curved travel path of the printing medium 1. In this way, a stable, well-guided printing medium edge 5 can be continuously assured. During its curved course, the travel path is bordered by at least one wall 10 on which air guide elements 6 and 7 border. Of course, for the sake of a better view, the wall 10 is not shown in FIG. 3; it is located between the air guide elements 6 and 7. The air guide elements 6 and 7 extend into the drawing plan and over the edge 5 of the printing medium 1.

Such an arrangement can be useful, for instance, in turnover mechanisms. It is particularly useful in a turnover mechanism, pursuant to DE 100 59 913C2. Therein, it is proposed that the printing medium 1 be turned over between belts. The travel path, in such a case, has a helix-shaped course, which can be followed by the printing media guide, according to the invention. In general, it is possible for the printing media guide to follow every conceivable change in the travel path. In this way, especially in the areas in which the travel direction of the printing medium 1 is changed, a stable guidance of the printing media edge can be achieved.

The printing media guide described here, and the use of the suction air stream 9 that it generates in order to guide and stabilize a printing medium edge 5, are intended to act mainly on both edges 5 of a printing medium 1. Action upon only one edge 5, can however, also be feasible if the remaining area of the printing medium 1 can be guided and/or held in place by other elements.

Figure 4:
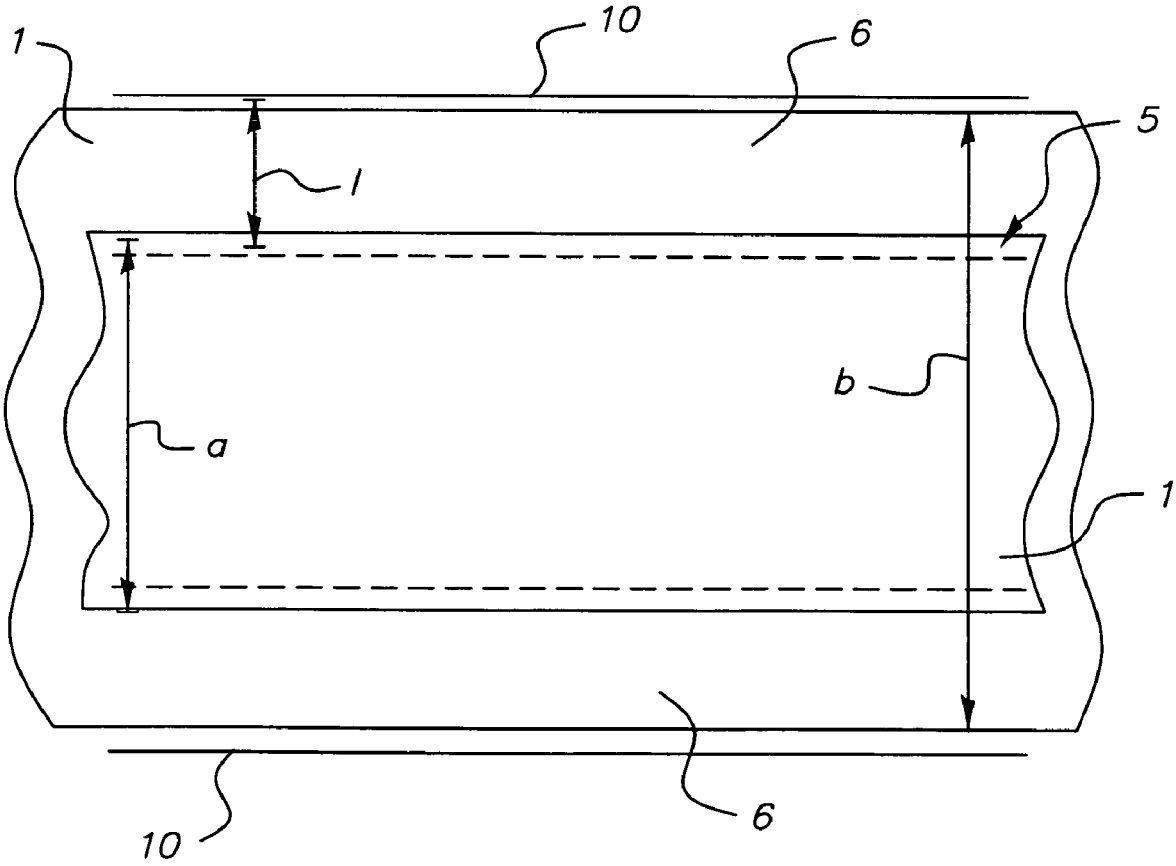
FIG. 4 is an overhead view of a printing media guide showing possible printing media widths.

FIG. 4 shows an overhead view of a printing media guide, in which one can see the range of width over which a printing medium can vary, and still have its edges 5 guided by the suction air stream 9. The travel path of the printing medium 1, is laterally delimited by the walls 10. Consequently, the maximal width b of a printing medium 1 is delimited by the fact that the printing medium 1 must not bump against a wall 10. Thus, a safety clearance in the range of millimeters should be maintained.

As long as edge area 5 of a printing medium 1 remains in the area of air guide elements 6 and 7, the suction air stream 9 can stabilize and/or guide the edge 5. A minimal width a of the printing medium 1 is consequently derived from the distance l, which represents how far the air guide elements extend into the travel path of the printing medium. In this regard the air guide elements 6 and 7 should preferably extend over the printing medium 1. A safety area in the range of millimeters, by which the air guide elements 6 and 7 extend over the narrowest conceivable printing medium 1, is also recommended here.

As can be seen, the printing media guide can readily accommodate various widths of the printing medium 1. Of course, the distance l, by which the air guide elements 6 and 7 should extend into the area of the travel path, should be selected such that even the narrowest expectable printing medium 1 can be guided by the suction air stream 9. The distance between the walls 10 should be great enough so that a printing medium 1 with the maximum expectable width can fit between the walls 10.

Aside from these considerations, no adjustments during the operation of the printing media guide are necessary. In general, different gram weights, i.e., weights of the printing media in use, do not require readjustment of the printing media guide during operation.

Thus, being introduced here, is a printing media guide that can readily accommodate different printing media 1, and that makes possible in a very simple way, stabilization and/or guidance of printing media 1 that are being conveyed in such a way that at least one edge 5 is contact-free. Undesirable movements of edges 5 can thus be ideally avoided. Other difficulties can also be quickly corrected. As soon as the printing medium edge 5 moves away from its position midway between the air guide elements 6 and 7, the suction air stream 9 guides it quickly back to a central position. Undesirable bending of the edges 5 can be avoided and desired bending, for example, during operation within a turnover mechanism, can be precisely achieved. However, it is not absolutely necessary that the printing medium edge 5 lies midway between the air guide elements 6 and 7. An array of air vent holes in the wall 10 allows the printing medium edges 5 to assume other than midway positions between the air guide elements 6 and 7, but the midway position is preferred.

In addition, the printing media guide is very sturdy and is not subjected to being adversely affected in the face of other undesirable effects. For example, changes in the alignment of the air guide elements 6 and 7 do not substantially adversely affect the operation of the printed media guide. A position of the air guide elements 6 and 7, that is, exactly parallel to the plane of the travel path, is not necessary for the printing media guide to operate. To a large extent, changes in the alignment of the air guide elements 6 and 7 across a broad range of degrees can be tolerated.

The invention has been described in detail with particular reference to certain preferred embodiments thereof, but it will be understood that variations and modifications can be effected within the spirit and scope of the invention.

What is claimed is:

1. A printing media guide for guiding a printing medium (1) that is being conveyed along a travel path in a printing machine, whereby said printing medium is not making contact along at least one edge (5), said printing media guide comprising at least one air suction mechanism (8) for sucking air out of an area of said travel path of said printing medium (1) along a wall (10) of said travel path, in order to create a suction air stream (9) that is directed at least partially outward and wherein said air suction mechanism (8) comprises an array of air vent holes (11) in said wall (10), wherein at least one of the vent holes is positioned entirely above or below the travel path of the printing medium, whereby said air vent holes are placed in such positions to create said suction air stream (9) to support the printing medium (1) from above and below wherein one air guide element (6 and 7) acts upon said suction air stream (9) and said at least one air guide element (6 and 7) above or below said printing medium (1) extends into said area of said travel path, essentially in a plane parallel with said printing medium (1).

2. A printing media guide, according to claim 1, wherein said air guide elements (6 and 7) border on said air suction mechanism (8) and extend into an area of a travel path of a narrowest expectable printing media.

3. A printing media guide, according to claim 2, wherein said air suction mechanism (8) and said air guide elements (6 and 7), follow said travel path.

4. A printing media guide, according to claim 3, wherein said air suction mechanism (8) that has air vent holes (11), and that laterally delimits said travel path of said printing medium (1).

5. A printing media guide, according to claim 3, wherein said air suction mechanism (8) has at least one antechamber (12).

6. A printing media guide, according to claim 3, wherein one air guide element (6 and 7) acts upon said suction air stream (9).

7. A printing media guide, according to claim 6, wherein said at least one air guide clement (6 and 7) above and below said printing medium (1) extend into said area of said travel path, essentially in a plane parallel with said printing medium (1).

* * * * *

UNITED STATES PATENT AND TRADEMARK OFFICE

CERTIFICATE OF CORRECTION

PATENT NO. : 7,392,984 B2
APPLICATION NO. : 10/887581
DATED : July 1, 2008
INVENTOR(S) : Domingo Rohde et al.

It is certified that error appears in the above-identified patent and that said Letters Patent is hereby corrected as shown below:

Column 6, Line 27, delete “media guide” and insert --medium--

Column 6, Line 61, delete “clement” and insert --element--

Signed and Sealed this

Twenty-third Day of December, 2008

JON W. DUDAS
*Director of the United States Patent and Trademark Office*